US007299936B2

(12) United States Patent
Singh et al.

(10) Patent No.: US 7,299,936 B2
(45) Date of Patent: Nov. 27, 2007

(54) TWO COMPARTMENTS BEVERAGE BOTTLE

(75) Inventors: Manjit C. N. G. Singh, Leeds (GB); Daljit C. N. G. Singh, Sheffield (GB)

(73) Assignee: Votum Enterprise Limited, West Yorkshire (GB)

( * ) Notice: Subject to any disclaimer, the term of this patent is extended or adjusted under 35 U.S.C. 154(b) by 0 days.

(21) Appl. No.: 10/531,087

(22) PCT Filed: Oct. 16, 2003

(86) PCT No.: PCT/GB03/04481

§ 371 (c)(1),
(2), (4) Date: Apr. 7, 2006

(87) PCT Pub. No.: WO2004/035418

PCT Pub. Date: Apr. 29, 2004

(65) Prior Publication Data

US 2006/0213854 A1 Sep. 28, 2006

(30) Foreign Application Priority Data

Oct. 16, 2002 (GB) ..... 0223981.2

(51) Int. Cl.
*B65D 1/04* (2006.01)

(52) U.S. Cl. ..... 215/10; 215/6; 206/499; 222/84

(58) Field of Classification Search ..... 215/6, 215/10, DIG. 8; 206/499; 222/94, 485
See application file for complete search history.

(56) References Cited

U.S. PATENT DOCUMENTS 856,064 A * 6/1907 Jackson ..... 222/142.5
1,418,814 A * 6/1922 Lutz et al. ..... 215/6
1,981,446 A * 11/1934 Apfelbaum ..... 222/136
2,288,044 A * 6/1942 Stemme ..... 215/12.1
2,321,998 A * 6/1943 Crouch et al. ..... 215/6
3,217,931 A * 11/1965 Farrar et al. ..... 222/94
3,506,157 A * 4/1970 Dukess ..... 222/94
4,279,349 A * 7/1981 Aigner ..... 215/6
4,410,085 A * 10/1983 Beneziat et al. ..... 206/217
4,678,103 A * 7/1987 Dirksing ..... 222/130
4,793,476 A * 12/1988 Schrupp ..... 206/222
4,915,242 A * 4/1990 Marte ..... 215/11.1
5,437,381 A * 8/1995 Herrmann ..... 215/11.1
5,456,090 A * 10/1995 McCoy ..... 62/372
5,607,072 A * 3/1997 Rigney et al. ..... 215/10
5,897,007 A * 4/1999 Schein et al. ..... 215/11.1

(Continued)

FOREIGN PATENT DOCUMENTS

GB 1279226 A 6/1972

(Continued)

*Primary Examiner*—Sue A. Weaver
(74) *Attorney, Agent, or Firm*—Cherskov & Flaynik

(57) ABSTRACT

The present invention provides a beverage bottle comprising an outer bottle (2) and an inner container (4). The inner container holds a first liquid (such an alcoholic spirit or a flavoured concentrate) and the space between the outer container and the inner container holds a second liquid (such as a still or carbonated mixer). The inner container (4) is twisted along its length to resist the flow of the first liquid to ensure that if the contents are consumed directly from the beverage bottle, every mouthful contains substantially the same ratio of first and second liquids.

13 Claims, 1 Drawing Sheet

U.S. PATENT DOCUMENTS

| | | | | | |
|---|---|---|---|---|---|
| 6,059,443 | A * | 5/2000 | Casey | 366/130 | |
| 6,179,146 | B1 * | 1/2001 | Betras | 220/23.4 | |
| 6,269,979 | B1 * | 8/2001 | Dumont | 222/145.1 | |
| 6,494,056 | B1 * | 12/2002 | Roth et al. | 62/457.3 | |

FOREIGN PATENT DOCUMENTS

| | | | |
|---|---|---|---|
| WO | WO92/02434 | * | 2/1992 |
| WO | WO 00/10907 | | 3/2000 |

* cited by examiner

TWO COMPARTMENTS BEVERAGE BOTTLE

TECHNICAL FIELD

The present invention relates to beverage bottles, and in particular to beverage bottles for separately containing different liquids.

BACKGROUND ART

"Alcopop" beverages consist of a blend of an alcoholic spirit such as vodka or white rum and a still or carbonated mixer such as water, tonic or fruit juice. They also contain a large amount of artificial additives like flavourings, colourings and chemical stabilisers, which can adversely affect or compromise the pure taste of the mixer. The same is also true for some types of non-alcoholic beverages where a flavoured concentrate is blended with a still or carbonated mixer such as water, tonic or lemonade.

Beverage bottles having inner and outer containers for holding separate liquids are already known. For example, British Patent 1279226 discloses a beverage bottle having an outer bottle 1 and a straight-sided glass tube 2 for holding a flavoured concentrate or syrup. The tube 2 rests on a support 3 provided in the base of the bottle 1 and is secured in the mouth of the bottle by a conical attachment 5. The space outside of the tube 2 holds a mixer such as soda water. The open end of the tube 2 and the mouth of the bottle 1 lie substantially in one plane and can be closed by a single crown cap 8. When the crown cap 8 is removed, the contents of the tube 2 and the bottle 1 can be poured into a glass so that a flavoured soda water is obtained.

The separate liquids are normally mixed to create the final "alcopop" or non-alcoholic beverage by pouring the entire contents of the beverage bottle into a glass in a single action. This means that the volume of the inner container and the volume between the inner container and the outer container must be chosen so that the correct amount of alcoholic spirit or flavoured concentrate and mixer end up in the glass. However, it is now common for the separate liquids to be consumed directly from the beverage bottle. This imposes a further requirement on the design of the beverage bottle because the ratio of alcoholic spirit or flavoured concentrate to mixer must be the same for each mouthful. In other words, the rate at which the alcoholic spirit or flavoured concentrate and mixer are dispensed through the mouth of the beverage bottle must be carefully controlled. If the rate is not controlled then the consumer may find that they have drunk all of the mixer but that some of the alcoholic spirit or flavoured concentrate is still left, or vice versa.

SUMMARY OF THE INVENTION

The present invention provides a beverage bottle comprising an outer container for holding a first liquid and a twisted inner container, within the outer container, for holding a second liquid such that the first and second liquids are kept separate until they are poured or dispensed from the bottle.

The inner container is twisted along its length to control the rate at which the second liquid is dispensed from the beverage bottle. Because the interior surface of the inner container is helical it creates complex shear forces that resist the flow of the second liquid out of the inner container. These shear forces also produce a small vortex-like rotational force that helps to mix the first and second liquids together in the neck of the beverage bottle when they are dispensed. The number of twists can be selected to accurately determine the rate at which the inner liquid is dispensed so that every mouthful of beverage taken directly from the beverage bottle contains substantially the same ratio of first and second liquids.

The inner and outer containers are preferably separately formed.

If the beverage bottle is used to market an "alcopop" beverage then an alcoholic spirit can be held within the inner container and a still or carbonated mixer can be held within the space between the inner container and the outer container, or vice versa. Because the alcoholic spirit and the mixer are kept separate until the contents of the beverage bottle are poured or dispensed then the resultant "alcopop" beverage will taste like it has just been freshly mixed. Furthermore, if the mixer is a fruit juice or spring water, for example, then any artificial additives can be added to the alcoholic spirit in the inner container so that the taste of the mixer is not compromised. It will be readily appreciated that the beverage bottle can also be used to market non-alcoholic beverages. In this case, a flavoured concentrate can be held within the inner container and a mixer can be held within the space between the inner container and the outer container, or vice versa.

For any particular "alcopop" or non-alcoholic beverage, the amount of alcoholic spirit or flavoured concentrate is normally much less than the amount of mixer. The volume of the inner container and the space between the inner container and the outer container can therefore be selected so that the correct ratio of alcoholic spirit or flavoured concentrate to mixer is achieved when the contents are poured into a glass.

The inner and outer containers are preferably transparent so that the first and second liquids are visible within the beverage bottle. To improve the appearance of the beverage bottle, the first liquid can be colourless and the second liquid can be coloured. If the second liquid is a normally clear alcoholic spirit such as vodka or white rum then a natural food-grade colouring can be added or the inner container can be made from an opaque or translucent coloured material.

The inner container is preferably fixed to a sleeve positioned in the neck of the beverage bottle. The sleeve can be press-fitted in the open end of the outer container or secured using an adhesive or mechanical fixing. The inner container is preferably secured to the base of the outer container to prevent any movement within the outer container during transit or storage. For example, the base of the outer container can be formed with a supporting collar or central depression into which the bottom part of the inner container is received.

The sleeve preferably has at least one first aperture to allow the first liquid between the inner container and the outer container to be poured or dispensed from the beverage bottle. A second aperture is also preferably provided in the sleeve to allow the second liquid in the inner container to be poured or dispensed from the beverage bottle. The sleeve can include an outer sleeve that is positioned in the neck of the outer container and an inner sleeve that defines the second aperture and is connected to the outer sleeve by one or more radial bridge pieces. The top part of the inner container is preferably received within the inner sleeve.

To keep the first and second liquids completely separate, at least one of the first aperture and the second aperture is preferably closed by means of a seal or liner. The same seal or liner may also close both the first aperture and the second aperture. One example of a seal is a plastics or rubber plug that sits on top of the sleeve and is trapped between the sleeve and the bottle cap. However, it will be readily apparent that any suitable seal or liner can be used.

The rate at which the first and second liquids are dispensed can also be controlled by altering the ratio of the cross-sectional area of the at least one first aperture to the cross-sectional area of the second aperture. This also helps to ensure that each mouthful taken directly from the beverage bottle contains substantially the same ratio of first and second liquids.

The twisted inner container can be formed from a closed sleeve having a substantially circular, rectangular, square or triangular cross-section.

Both the inner and outer containers can be formed from a glass or plastics material.

DETAILED DESCRIPTION OF THE INVENTION

Figure 1:
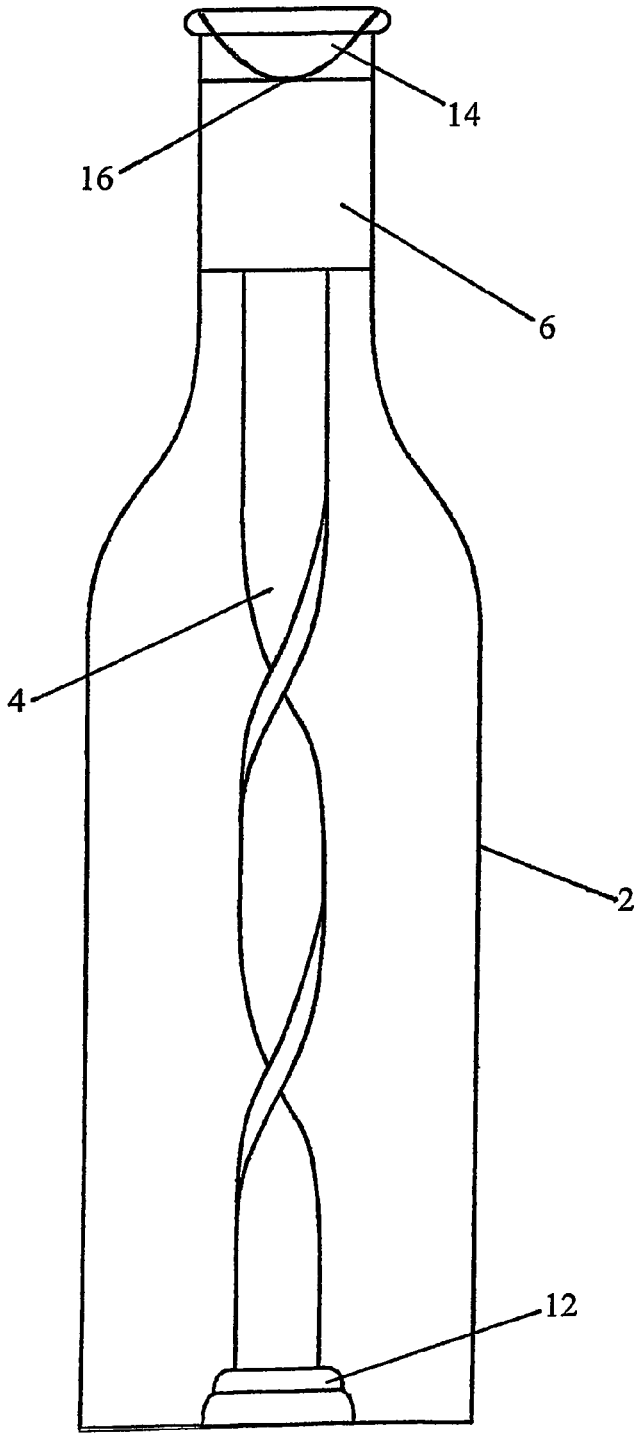
FIG. 1 shows a side view of a beverage bottle in accordance with the present invention.
Figure 2:
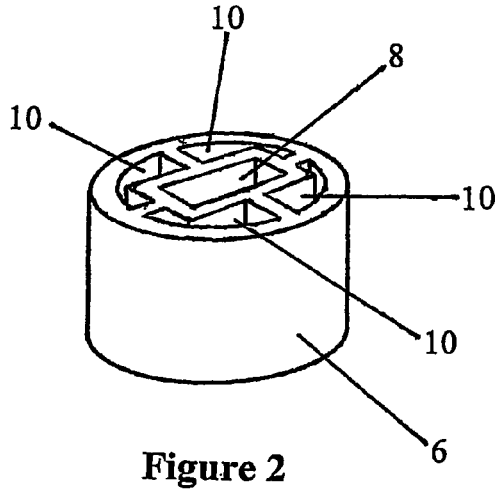
FIG. 2 shows a perspective view of an inner sleeve that is positioned in the neck of the beverage bottle of FIG. 1.

FIG. 1 shows a beverage bottle having a glass outer bottle 2 and a PET inner container 4. A sleeve 6, shown in detail in FIG. 2, is positioned in the neck of the outer bottle 2 and is formed from a plastics material. The sleeve 6 is a press-fit in the open end of the outer bottle 2 but it will be appreciated that the sleeve may be secured using an adhesive or the interior surface of the outer bottle may be formed with projections or an annular rib to support the sleeve from below. The sleeve 6 has central rectangular aperture 8 and four radially outer apertures 10. The inner container 4 has a rectangular cross-section and is a press-fit in the central aperture 8. The top part of the inner container 4 is therefore firmly held in place in the neck of the beverage bottle by the sleeve 6. The liquid contents of the inner container 4 can be poured or dispensed through the central aperture 8. Similarly, the liquid contents of the space between the outer bottle 2 and the inner container 4 can be poured or dispensed through the outer apertures 10.

The bottom part of the inner container 4 is received within a support collar 12 that is fixed to the base of the outer bottle 2. The support collar 12 holds the inner container 4 steady and prevents any movement within the outer bottle during transit or storage.

The inner container 4 is twisted along its length. Although the inner container 4 shown in FIG. 1 has three separate twists, it will be readily appreciated that the inner container 4 may have any number of twists for the reasons described below.

The space between the outer bottle 2 and the inner container 4 is filled with a clear still or carbonated mixer such as spring water or tonic. The inner container 4 is filled with an alcoholic spirit such as vodka or white rum. In this way, the alcoholic spirit and the mixer are kept separate and are only blended together when they are poured into a glass, or consumed directly from the beverage bottle. To improve the appearance of the beverage bottle, a food-grade colouring is added to the alcoholic spirit. The coloured contents of the inner container 4 will therefore be visible through the clear mixer and if the beverage bottle is backlit on the shelf of a bar, club or restaurant then it will take on a highly distinctive "jewelled" appearance. Any artificial additives are also added to the alcoholic spirit so that the taste of the mixer is not compromised.

The ratio of the volume of the inner container 4 and the volume of the space between the outer bottle 2 and the inner container is selected so that the correct blend of alcoholic spirit to mixer is achieved when the contents of the beverage bottle are poured into a glass. For example, if the correct blend of alcoholic spirit to mixer is 1:5 then the volume of the inner container 4 is five times smaller than the volume of the space between the outer bottle 2 and the inner container.

The contents can also be consumed directly from the beverage bottle and the number of twists in the inner container 4 controls the rate at which the alcoholic spirit is dispensed. This ensures that every mouthful contains substantially the same ratio of alcoholic spirit and mixer. Complex shear forces resist the flow of the alcoholic spirit out of the inner container 4 and produce a small vortex-like rotational force that helps to mix the alcoholic spirit and the mixer together in the neck of the beverage bottle before they are drunk.

Further control over the rate at which the alcoholic spirit and mixer are dispensed is achieved by altering the ratio of the cross-sectional areas of the central aperture 8 and the outer apertures 10.

The outer bottle 2 is closed with a suitable cap (not shown). To maintain the total separation between the alcoholic spirit and the mixer, a dome-shaped rubber plug 14 is positioned on top of the sleeve 6. The domed end 16 of the plug 14 seals against the central aperture 8 to prevent the alcoholic spirit in the inner container 4 from entering the space between the outer bottle 2 and the inner container. The plug 14 is pressed down firmly against the sleeve 6 by the cap (not shown). It will be readily appreciated that any other suitable seal or liner can be used instead of the plug 14. In particular, the seal or liner can be made integral with the cap (not shown).

The invention claimed is:

1. A beverage bottle comprising an outer container for holding a first liquid and an inner container within the outer container for holding a second liquid such that the first and second liquids are kept separate until they are poured or dispensed from the bottle wherein the inner container defines an inner surface that is substantially helical in configuration so as to cause simultaneous dispensing of the first liquid and the second liquid.

2. The beverage bottle according to claim 1, wherein the inner container is fixed to a sleeve positioned in an open end of the outer container.

3. The beverage bottle according to claim 2, wherein the sleeve has a first aperture to allow the first liquid to be dispensed from the bottle and a second aperture to allow the second liquid to be dispensed from the bottle.

4. The beverage bottle according to claim 3, wherein at least one of the first aperture and the second aperture is sealed to keep the first and second liquids separate until the liquids in the bottle are dispensed.

5. The beverage bottle according to claim 3, wherein the first and second apertures are chosen to dispense the liquids contained in said containers at predetermined rates.

6. The beverage bottle according to claim 1, wherein the inner container is secured to a base of the outer container.

7. The beverage bottle according to claim 1, wherein the inner container is secured to a base of the outer container by means of a supporting collar.

8. The beverage bottle according to claim 1, wherein the inner container has a rectangular, square, or triangular cross-section.

9. The beverage bottle according to claim 1, wherein the outer container is formed of glass or a plastics material.

10. The beverage bottle according to claim 1, wherein the inner container is formed of glass or a plastics material.

11. The beverage bottle according to claim 1, wherein the outer and inner containers are transparent.

12. The beverage bottle according to claim 1, wherein the outer and inner containers dispense the liquids contained therein at a constant ratio.

13. The beverage bottle according to claim 1, wherein the inner container is twisted along its length with the number of twists selected so as to dispense the liquid contained therein at a predetermined rate.

* * * * *